US005441422A

United States Patent [19]

Steiner

[11] Patent Number: 5,441,422

[45] Date of Patent: Aug. 15, 1995

[54] CUTTING CLAMP FOR CONNECTING AN INSULATED CONNECTING WIRE

[75] Inventor: Ewald Steiner, Berg, Germany

[73] Assignee: Siemens Aktiengesellschaft, Munich, Germany

[21] Appl. No.: 244,063

[22] PCT Filed: Nov. 2, 1992

[86] PCT No.: PCT/DE92/00913

§ 371 Date: May 13, 1994

§ 102(e) Date: May 13, 1994

[87] PCT Pub. No.: WO93/10574

PCT Pub. Date: May 27, 1993

[30] Foreign Application Priority Data

Nov. 14, 1991 [DE] Germany ..... 41 37 507.6

[51] Int. Cl.[6] ..... H01R 4/24

[52] U.S. Cl. ..... 439/395; 439/397

[58] Field of Search ..... 439/395–404, 439/406, 407, 409, 410, 417–419

[56] References Cited

U.S. PATENT DOCUMENTS 4,097,107 6/1978 Hawkins .
4,220,390 9/1980 Cobaugh et al. .
4,682,835 7/1987 Aujla et al. ..... 439/395
4,806,119 2/1989 Herfort et al. .

FOREIGN PATENT DOCUMENTS 2708841 9/1977 Germany .

*Primary Examiner*—David L. Pirlot
*Attorney, Agent, or Firm*—Hill, Steadman & Simpson

[57] ABSTRACT

The clamping slot produced by shearing, of the insulation piercing connecting device extends in a jagged shape. One of the two clamping legs is deformed at the end of its foot in such a way that its free end is shortened or lengthened. As a result, the clamping legs are offset with respect to one another in the region of the clamping slot and are partially constricted or widened. The pressed-in connecting wire is thus securely held in the clamping slot.

11 Claims, 2 Drawing Sheets

11
12
13
8

3
4
2
6
5
A
2
7
1

6
7
1

4
2
5
3
2
1
18

4
18
1

2
4,5
3
2
1

CUTTING CLAMP FOR CONNECTING AN INSULATED CONNECTING WIRE

BACKGROUND OF THE INVENTION

1. Field of the Invention

The invention relates generally to connectors and more specifically to an insulation piercing connecting device. The clamping slot made of flat material with at least two clamping legs between which a clamping slot extends essentially in the longitudinal direction of the device is formed by a shearing cut. An insulated connecting wire can be pushed into the slot so as to produce a contact. The slot has at its free end, a constriction for retaining the connecting wire in the clamping slot.

2. Background of the Related Art

An insulation piercing connecting device of this kind has been disclosed for example in DE 27 08 841 C2. According to this, a rounded-off small projection which, in the vicinity of the free end, projects into the clamping slot, is formed on one of the clamping legs by crowding. This projection makes it more difficult to pull out the connecting wire which is otherwise held by friction only. In particular, the projection prevents the connecting wire from loosening, for example when vibration occurs.

Insulation piercing connecting devices of this kind are required in large numbers in terminal strips. The thin punch which performs crowding is subject to a high degree of wear which requires frequent changing with subsequent re-adjustment of the deformation depth. Punches made of harder material are correspondingly more brittle and are more likely to fracture.

SUMMARY OF THE INVENTION

It is an object of the present invention to provide a cutting clamp providing improved retaining force for connecting an insulated connecting wire.

The extent of the clamping slot with the oblique section is constructed as an indented contour in the punching tool, which contour can be produced easily and permits a high standing amount between the subsequent grinding. In this way, the material expulsion associated with a high degree of wear is dispensed with.

The longitudinal displacement of the two legs with respect to one another can be produced in different ways depending on the type of clamp. In the sloping section of the clamping slot, a widened portion is produced, in which the connecting wire is held securely in the manner of a positive engagement. When pulling out the connecting wire, force components are produced which counteract the pulling-out force.

In an embodiment, constrictions and widened portions which permit a reliable clamping of the connecting wire are produced on the clamping slot. The sharp serration prevents pulling out to a greater degree than a rounded-off projection. When the clamping legs are displaced with respect to one another, they are spread apart from one another so that the widened portion of the clamping slot is further increased.

In another embodiment, the additional deflection of the clamping legs caused by the jagged edge is kept small without reducing the pulling-out force.

In a further embodiment, the outer slope of the depression is displaced inwards in relation to the projection so that it lies at least partially opposite the inner slope of the projection. The clamping slot is constricted in this area with a double inclination and as a result reliably prevents automatic slipping out, for example due to vibrations. Unintentional effects, e.g. when working on adjacent cutting clamps, require a discernible expenditure of force in order to release the connecting wire. These effects are accounted for in the present invention.

In another embodiment, it is possible to carry out the longitudinal displacement by selecting a suitable material and type of clamp.

In another embodiment, a bead-like bent-out portion can be constructed at low cost. However, in the case of spatial restrictions with respect to the extension perpendicular to the plane of the material, stretching of one of the clamping legs is to be preferred. As a result of which the thinness of the cutting clamp is retained.

In an embodiment, the shortening of the leg can be combined with an offset of the legs in the direction of the connecting wire. This produces improved contacting properties which result from an increased edge effect at the cutting faces.

In yet another embodiment, the clamping legs are precisely guided in the insulating material carrier so that defined conditions in the geometry of the cutting clamp are ensured. In particular, the clamping legs are prevented from splaying out too far perpendicular to the plane of the material. As a result of which the alternating effect between the projection and the depression would be put at risk.

In an embodiment, two connecting wires can be connected to the cutting clamp independently of one another, thereby requiring only a single bent-out portion. A cutting clamp constructed of a flat material, having at least two clamping legs and a clamping slot that is formed by a shearing cut and extends between the legs essentially in the longitudinal direction of the cutting clamp, so that an insulated connecting wire can be pushed into the slot to produce a contact, the clamping slot having a constriction near its free end, wherein the clamping slot further has an obliquely extending section near its free end to produce a first shoulder at a first clamping leg which points towards the free end and a second shoulder at a second clamping leg which points in the opposite direction, the second shoulder being oriented longitudinally in relation to the first shoulder towards the free end, so that the connecting wire can be pushed into the obliquely extending section.

The invention is explained in greater detail below with reference to exemplary embodiments illustrated in the figures.

DETAILED DESCRIPTION OF THE PREFERRED EMBODIMENTS

Figure 1:
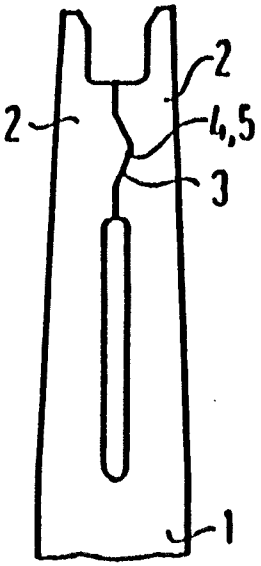
FIG. 1 shows a side view of an insulation piercing connecting device with two clamping legs and a central clamping slot of the present invention.

According to FIG. 1, a cutting clamp 1 has two clamping legs 2 which are separated from one another by means of a central shearing cut, the cutting line producing a clamping slot 3 which extends in a jagged shape. As a result, one clamping leg 2 has a jagged projection 4 has a corresponding depression 5 lying opposite it in the other clamping leg 2. The jagged course is obtained in a simple manner by appropriately shaping a blanking punch and a cutting plate.

Figure 2A:
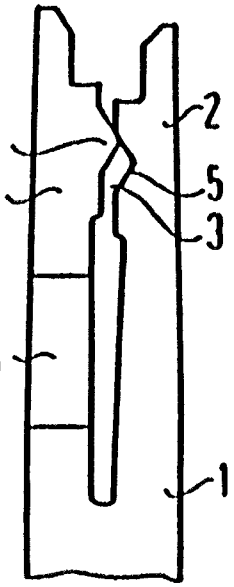
FIGS. 2, 2*a* show different side views of the cutting clamp of the present invention according to FIG. 1 with a clamping leg stretched by stamping.
Figure 2:
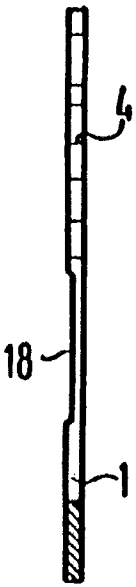

According to FIGS. 2 and 2*a*, the clamping leg 2, having the jagged projection 4, of the cutting clamp 1 has an impression 18 in its foot part. As a result, the clamping leg 2 is lengthened approximately by the height of the jagged projection 4 which slopes at an obtuse angle. In this case, the two clamping legs are displaced with respect to one another and are easily pressed apart. They lie closely against one another with the section which is outwardly adjacent to the tip of the projection 4. In the opposite direction, the clamping slot widens in accordance with the angular sum of the two legs of the projection 4.

Figure 3A:
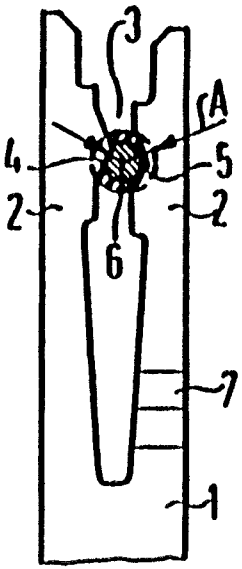
FIGS. 3, 3*a* show two side views of the cutting clamp of the present invention according to FIG. 1 with a, shortened clamping slot and a connecting wire.
Figure 3:
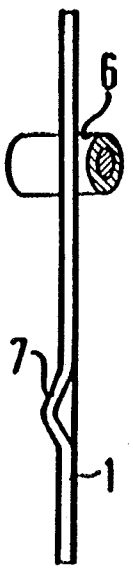

In accordance with FIGS. 3 and 3*a*, the offset between the two clamping legs 2 is achieved by means of a bent-out portion 7 in the foot of the clamping leg 2 which has the depression 5. An insulated connecting wire 6 is pressed into the clamping slot 3 to the depression 5 and behind the tip of the projection 4. The clamping slot 3 tapers outwards from the connecting wire 6 so that when pulling-out forces occur in accordance with the arrows A on the connecting wire 6, counteracting forces caused by the spring force of the clamping legs result and have an axial component. The latter counteracts the pulling-out force. This spring force which prevents a pulling-out of the connecting wire 6 is in addition to the frictional forces present. Thus, the connecting wire 6 is securely held in the clamping slot 3.

Figure 5:
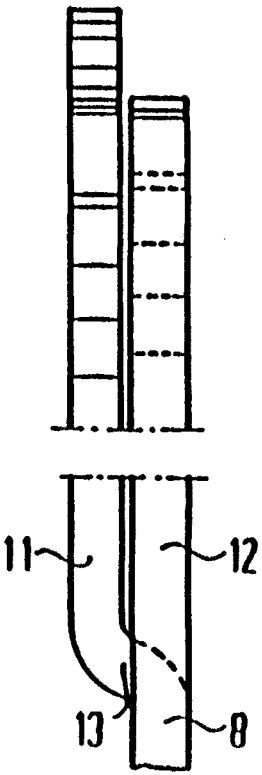
FIG. 5 shows a side view of the cutting clamp of the invention according to FIG. 4.
Figure 4:
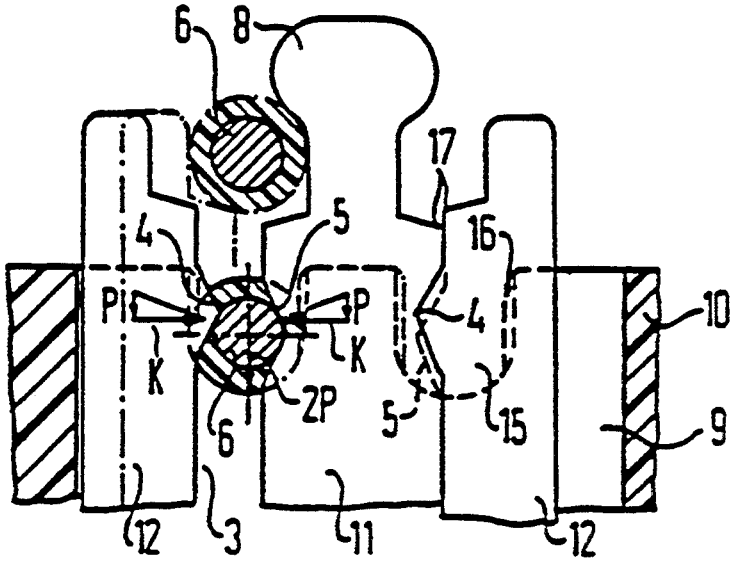
FIG. 4 shows a partial side view of another embodiment of a cutting clamp of the present invention which is received in a chamber of an insulating material housing.
Figure 6:
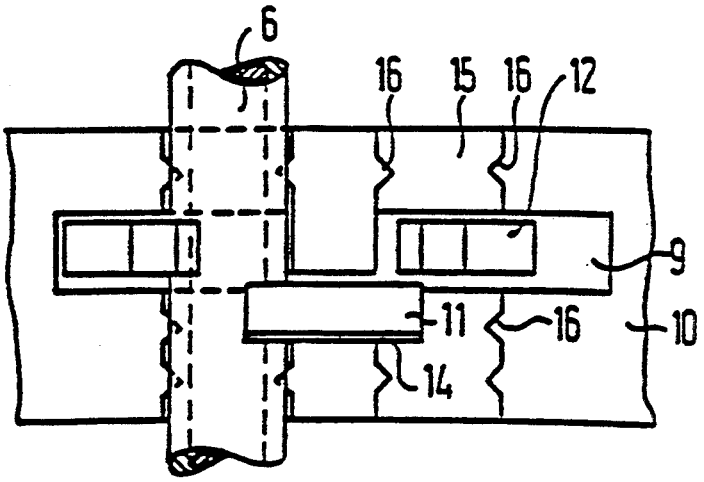
FIG. 6 shows a plan view of the elements of the invention according to FIG. 4.

According to FIGS. 4, 5 and 6, an alternate embodiment of a cutting clamp 8 is inserted into a receptacle chamber 9 of an insulating element 10. The alternate cutting clamp 8 has a central clamping leg 11 and two outer clamping legs 12 between which are two clamping slots 3 for pressing in and for connecting to connecting wires 6.

Referring to FIG. 5, at the end 13 of its foot, the central clamping leg 11 is bent out of the plane of the material at right angles in a double bend by approximately the thickness of the material of the alternate cutting clamp 8. As illustrated in FIG. 6, the receptacle chamber 9 has a corresponding recess 14 in which the central clamping leg 11 is fixed laterally.

As a result, the two outer clamping legs 12 are separated due to their spring effect. The latter is thus independent of whether one connecting wire or two connecting wires are connected. The outer clamping legs 12 are guided in the receptacle chamber 9 in such a way that they can only be splayed apart in the plane of the material.

Furthermore, in the insulating element 10 there are holding slots 15 for the connecting wires 6 formed on the two sides of the receptacle chamber 9. These holding slots 15 have rib-like clamping webs 16 which press into the insulation of the connecting wire 6 in a tensile stress-relieving fashion and counteracts the pulling-out force as a result of additional friction forces.

When the connecting wire 6 is pushed into the clamping slot 3 its insulation is removed by means of cutting edges 17 on the end side of the clamping slot 3 so that the clamping legs move into contact with the metallic core of the connecting wire 6. The left-hand half of FIG. 4 shows the left-hand clamping leg 12 with the connecting wire 6 directly before (shown by dot-dash lines) and after being pressed into the clamping slot 3. The fight-hand half of the figure shows the alternate cutting clamp 8 without connecting wire. Here, it can be seen that the central clamping leg 11 is shortened in relation to the outer clamping leg 12 by means of the double bend at the end 13 of the foot. The jagged projection 4 is located on the outer clamping leg 12 and the corresponding depression 5 on the central clamping leg 11.

The depression 5 is thus offset towards the end 13 of the foot with respect to the projection 4. Since the clamping legs 11, 12 which are separated from one another by shearing extend in different planes, they are not pressed apart when the central clamping leg 11 bends out, as is illustrated for example in FIG. 2*a*. Due to the longitudinal offset, partial overlapping occurs in the region of the jagged edge.

The core of the pressed-in connecting wire 6 is pushed away via the tip of the projection 4 on the outer clamping leg 12 and locks in the depression 5 of the central clamping leg 11. Here, the core of the connecting wire 6 rests against the inner leg of the projection 4 and against the outer leg of the depression 5. If an attempt is made to pull out the connecting wire 6, the clamping force K of the alternate cutting clamp 8 becomes effective at this point. As a result of the slopes which come to a point, axial force components P which counteract the pulling-out force and which add up to form an overall opposing force 2P are produced. The latter can be of such a magnitude that it would only be possible to pull the connecting wire out of the clamping slot 3 with a considerable expenditure of force. The wire is thus particularly secured against coming free accidentally.

Although other modifications and changes may be suggested by those skilled in the art, it is the intention of the inventors to embody within the patent warranted hereon all changes and modifications as reasonably and properly come within the scope of his contribution to the art.

I claim:

1. A cutting clamp constructed of a flat material, having at least two clamping legs and a clamping slot that is formed by a shearing cut and extends between said legs essentially in the longitudinal direction of said cutting clamp, so that an insulated connecting wire can be pushed into said slot to produce a contact, said clamping slot having a constriction near its free end, wherein said clamping slot further comprises an obliquely extending section near its free end to produce a first shoulder at a first clamping leg which points towards said free end and a second shoulder at a second clamping leg which points in the opposite direction, said second shoulder being oriented longitudinally in relation to said first shoulder towards said free end, so that said connecting wire can be pushed into said obliquely extending section, said shoulders after the shearing operation being shifted away from each other in the longitudinal direction of the clamp by deformation of at least one of said legs.

2. The cutting clamp according to claim 1, wherein said two ends of said legs are offset from one another by stretching.

3. The cutting clamp according to claim 1, wherein said clamping slot has an obtusely angled jagged shape near its free end which produces a jagged projection having a tip on said first clamping leg and a corresponding jagged depression on said second clamping leg, such that said projection and said depression are offset with respect to one another in the longitudinal direction, and said connecting wire can be pushed into said clamping slot as far as under said tip of said projection.

4. The cutting clamp according to claim 3, wherein said projection has a height less than the thickness of said cutting clamp.

5. The cutting clamp according to claim 3, wherein said depression is disposed at a greater distance from said free slot end than from said projection.

6. The cutting clamp according to claim 1, wherein said two ends of said legs are offset from one another by shortening to provide a shorter leg and a longer leg.

7. The cutting clamp according to claim 6, wherein said shorter clamping leg has a bent-out portion.

8. The cutting clamp according to claim 6, wherein said longer clamping leg has an impression which reduces its thickness and increases its length.

9. The cutting clamp according to claim 6, wherein said shorter leg has a short-right-angled double bend at the end of its foot and is bent out of the plane of said flat material by approximately the thickness of said flat material.

10. The cutting clamp according to claim 1, wherein said cutting clamp is inserted and guided in a receptacle chamber of an insulating element so that when said connecting wire is pressed in, said clamping legs can only be deflected in the plane of said flat material.

11. The cutting clamp according to claim 10, wherein said cutting clamp has a central clamping leg, at least two outer clamping legs and two clamping slots for one connecting wire each, wherein said central clamping leg has a double bend or bent-out portion at said end of its foot and that said outer clamping legs remain in the main plane of said flat material of said cutting clamp.

* * * * *